US005732957A

United States Patent [19]

Yu

[11] Patent Number: 5,732,957

[45] Date of Patent: Mar. 31, 1998

[54] ROLLER SKATE WITH AUXILIARY ROLLER FOR ASSISTING TURNING AND BRAKING ACTION THEREOF

[76] Inventor: Chung-Hsiung Yu, 2F, No. 94, Chung-Yuan St., Taipei City, Taiwan

[21] Appl. No.: 598,983

[22] Filed: Feb. 9, 1996

[51] Int. Cl.[6] ..... A63C 17/06

[52] U.S. Cl. ..... 280/11.19; 280/11.22; 280/11.27

[58] Field of Search ..... 280/11.19, 11.22, 280/11.23, 11.27, 11.28, 87.042

[56] References Cited

U.S. PATENT DOCUMENTS 4,134,598 1/1979 Urisaka ..... 280/11.22
4,460,187 7/1984 Shimuzu ..... 280/870.42
5,192,088 3/1993 Yu ..... 280/11.22
5,347,681 9/1994 Wattron et al. ..... 280/87.042

*Primary Examiner*—Richard M. Camby
*Attorney, Agent, or Firm*—Ladas & Parry

[57] ABSTRACT

A roller skate includes a skate body, a bracket and an auxiliary roller. The skate body has front and rear ends and a bottom side with a plurality of main rollers mounted rotatably thereon along a longitudinal axis which extends between the front and rear ends. The bracket is connected to the bottom side of the skate body at one of the front and rear ends, and has a spaced pair of parallel side plate portions which form an angle with the longitudinal axis of the skate body. The auxiliary roller is disposed between the side plate portions of the bracket and is mounted rotatably thereon.

9 Claims, 8 Drawing Sheets

ROLLER SKATE WITH AUXILIARY ROLLER FOR ASSISTING TURNING AND BRAKING ACTION THEREOF

BACKGROUND OF THE INVENTION

1. Field of the Invention

The invention relates to a roller skate, more particularly to a roller skate with an auxiliary roller for assisting the turning and braking action thereof.

2. Description of the Related Art

Referring to FIG. 1, a conventional roller skate is shown to comprise a skate body 10 and a roller mounting frame 11 mounted on a bottom side of the skate body 10. The roller mounting frame 11 has a plurality of rollers 12, which are aligned along a longitudinal axis thereof, mounted rotatably thereon. A brake device 13 is mounted on a rear end of the roller mounting frame 11. U.S. Pat. No. 5,192,088 by the applicant discloses a roller skate which further includes a device for assisting the turning and braking action thereof. The device includes a mounting seat attached to the bottom side of the skate body, a pair of mounting shafts mounted on the mounting seat such that they form an angle therebetween and such that they are symmetric with respect to the longitudinal axis of the skate body, and a pair of auxiliary rollers mounted respectively to the mounting shafts. The auxiliary rollers attribute a controlled and stabilized turning action to the roller skate. In addition, the auxiliary rollers further provide a movement-impeding action when the roller skate is braked.

A main drawback of the roller skate of the aforementioned patent resides in that the auxiliary rollers are visible from opposite sides of the roller skate, thereby affecting adversely the appearance and the consumer appeal of the latter.

SUMMARY OF THE INVENTION

Therefore, the object of the present invention is to provide a roller skate with an auxiliary roller for assisting the turning and braking action thereof, the auxiliary roller being concealed so as to prevent the latter from affecting adversely the appearance and the consumer appeal of the roller skate.

According to the present invention, a roller skate comprises a skate body, a bracket and an auxiliary roller. The skate body has front and rear ends and a bottom side with a plurality of main rollers mounted rotatably thereon along a longitudinal axis which extends between the front and rear ends. The bracket is connected to the bottom side of the skate body at one of the front and rear ends, and has a spaced pair of parallel side plate portions which form an angle with the longitudinal axis of the skate body. The auxiliary roller is disposed between the side plate portions of the bracket and is mounted rotatably thereon, thereby concealing the auxiliary roller. The auxiliary roller has a raised bottom with respect to the main rollers.

In one embodiment, the skate body includes a roller mounting frame with a spaced pair of parallel side walls. The main rollers are disposed between the side walls and are mounted rotatably thereon. The bracket extends integrally from the roller mounting frame.

In another embodiment, the bracket further has a top plate portion which is mounted rotatably on the bottom side of the skate body and which interconnects top ends of the side plate portions. One of the top plate portion of the bracket and the skate body is formed with a curved slot. The other one of the top plate portion of the bracket and the skate body is provided with a fastener which extends into the curved slot to retain adjustably the side plate portions at a desired angle with respect to the longitudinal axis of the skate body.

In a further embodiment, the bracket further has a spaced pair of parallel second side plate portions which extend inclinedly and respectively from the first side plate portions in a direction opposite to that of the first side plate portions. The second side plate portions form an angle with the longitudinal axis of the skate body. A second auxiliary roller is disposed between the second side plate portions of the bracket and is mounted rotatably thereon.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
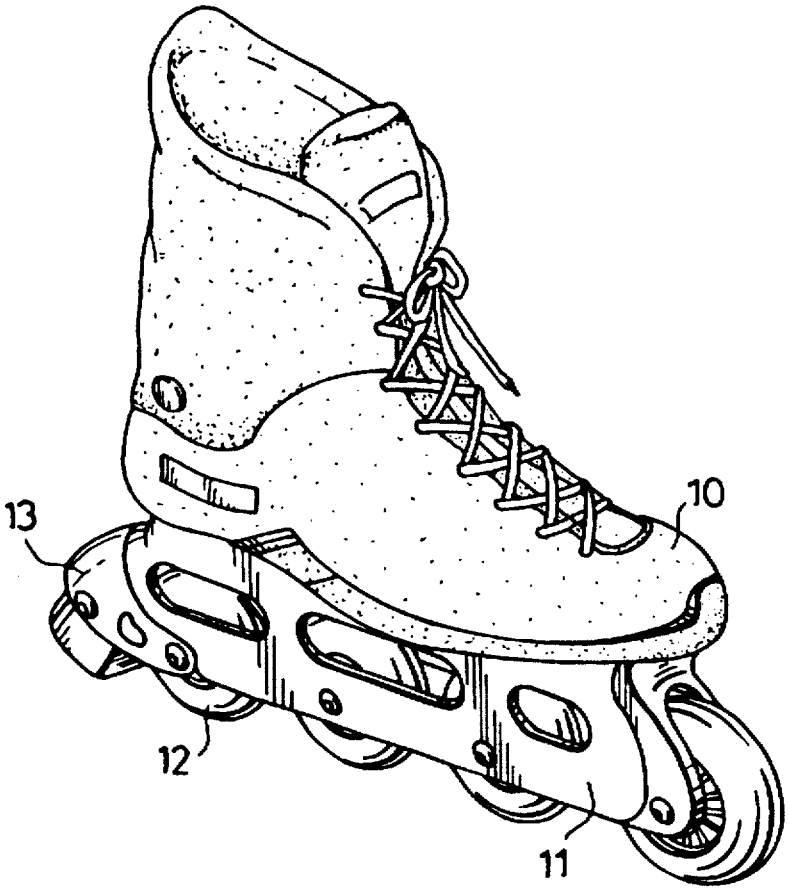
FIG. 1 PRIOR ART
FIG. 1 is a perspective view of a conventional roller skate.

Before the present invention is described in greater detail, it should be noted that like elements are denoted by the same reference numerals throughout the disclosure.

Figure 2:
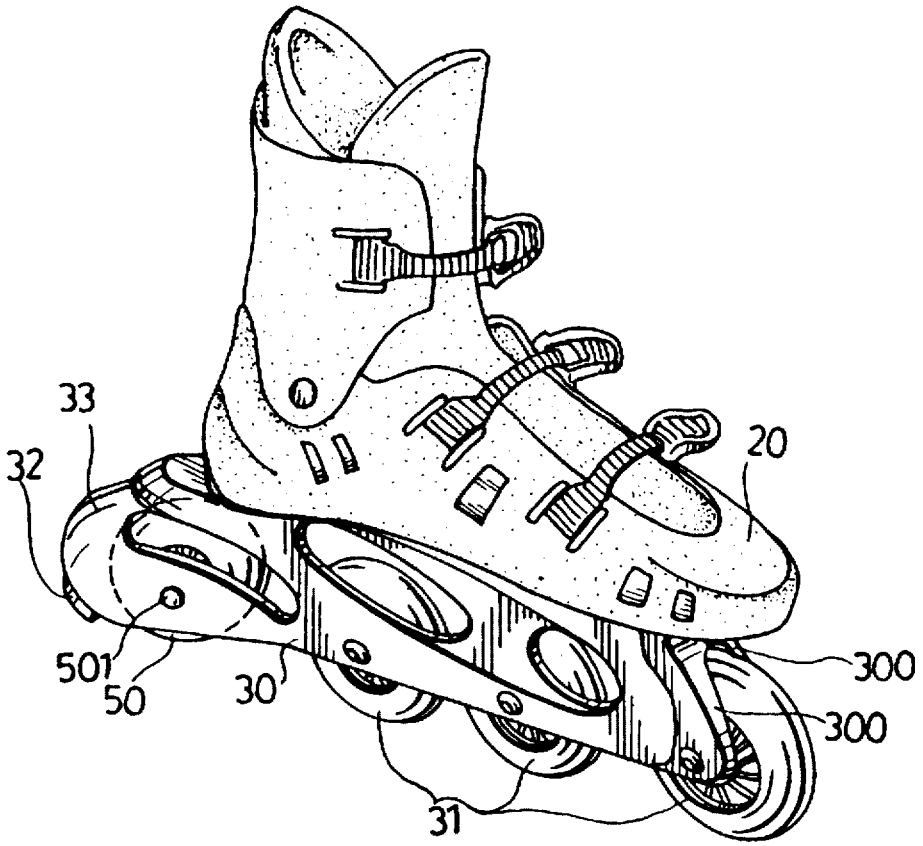
FIG. 2 is a perspective view of the first preferred embodiment of a roller skate according to the present invention.
Figure 3:
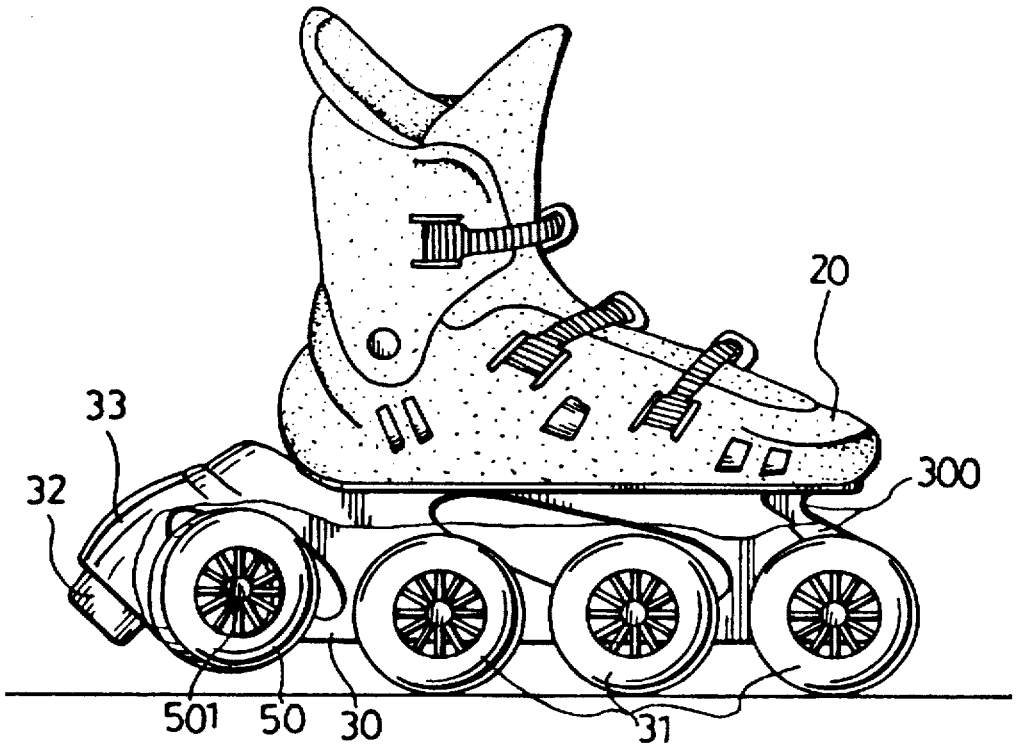
FIG. 3 is a schematic side view of the first preferred embodiment.

Referring to FIGS. 2 and 3, the first preferred embodiment of a roller skate according to the present invention is shown to comprise a skate body 20 and a roller mounting frame 30 mounted on a bottom side of the skate body 20. The roller mounting frame 30 has a spaced pair of parallel side walls 300. Three main rollers 31 are disposed between the side walls 300 and are mounted rotatably thereon. The main rollers 31 are aligned along a longitudinal axis which extends between front and rear ends of the skate body 20. A brake device 32 is mounted on a rear end of the roller mounting frame 30. In this embodiment, a bracket 33 extends integrally from the rear end of the roller mounting frame 30. The bracket 33 has a spaced pair of parallel side plate portions which form an angle with the longitudinal axis of the skate body 20. An auxiliary roller 50 is disposed between the side plate portions of the bracket 33 and is mounted rotatably thereon by a pin 501. The auxiliary roller 50 has a raised bottom with respect to the main rollers 31 and is concealed by the bracket 33. The auxiliary roller 50 assists the turning and braking action of the roller skate.

Figure 4:
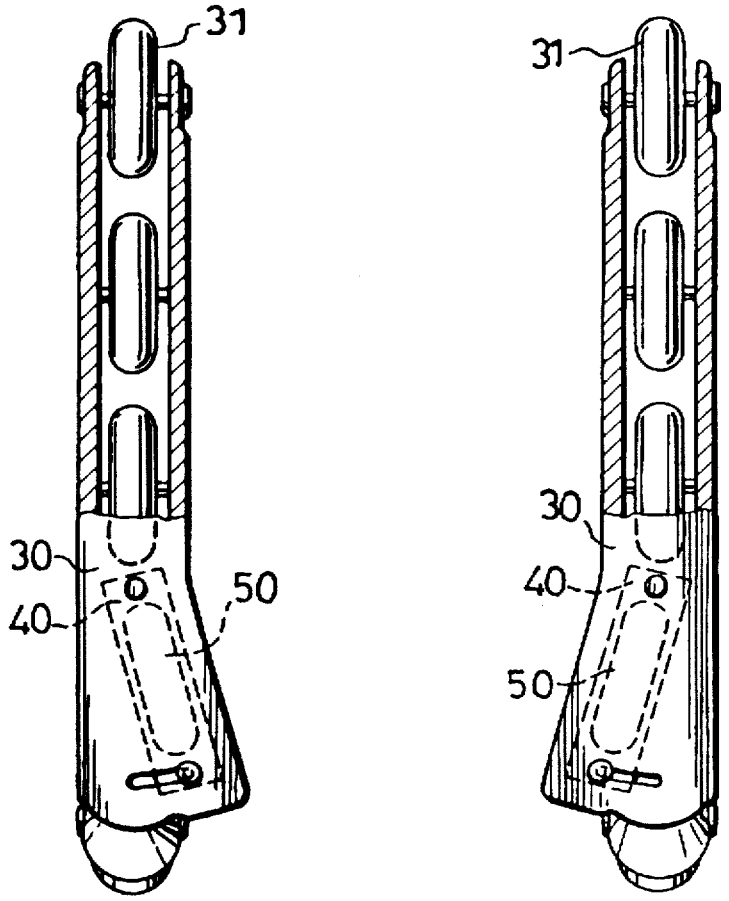
FIG. 4 is a partly sectional, schematic top view of a pair of roller skates of the second preferred embodiment.
Figure 5:
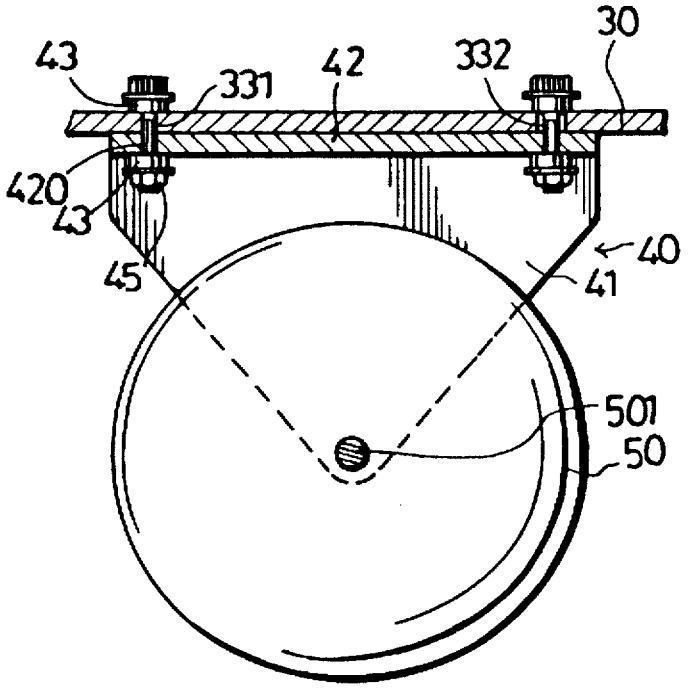
FIG. 5 is a partly sectional, schematic side view illustrating how an auxiliary roller of the second preferred embodiment is installed.
Figure 6:
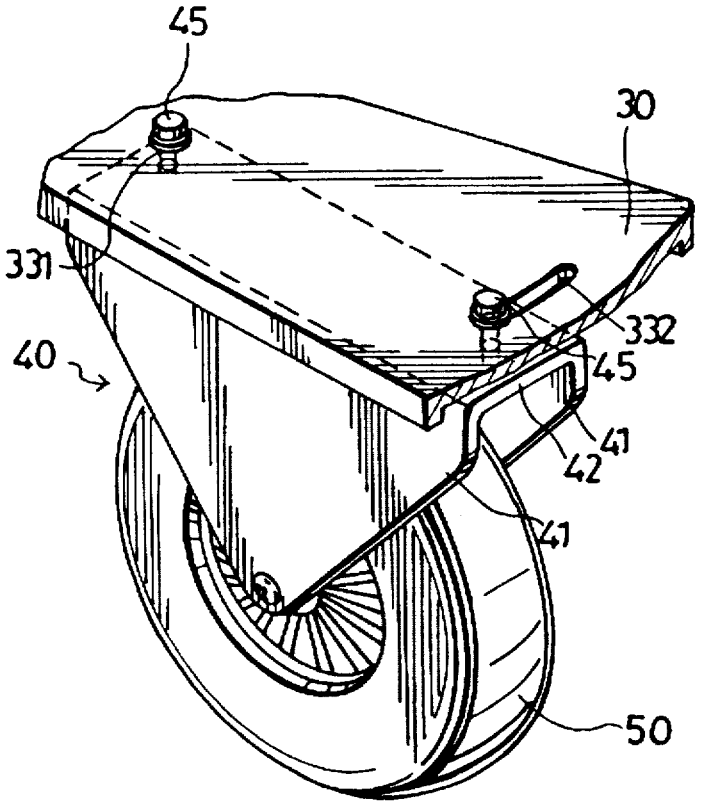
FIG. 6 is a fragmentary perspective view illustrating how the auxiliary roller of the second preferred embodiment is installed.

The second preferred embodiment of a roller skate according to the present invention is shown in FIGS. 4 to 6.

Referring to FIG. 4, the roller mounting frame 30 has a diverging rear end which receives a bracket 40 therein. The bracket 40 is mounted to the roller mounting frame 30 such that the side plate portions of the former form an angle between 0° and 60° with respect to the longitudinal axis of the skate body 20. The auxiliary roller 50 is disposed between the side plate portions of the bracket 40 and is mounted rotatably thereto. As with the previous embodiment, the auxiliary roller 50 has a raised bottom with respect to the main rollers 31. In use, the auxiliary roller 50 of the left roller skate should incline towards the right, while that of the right roller skate should incline towards the left. Thus, when the roller skates turn to the right or to the left, the roller skates tilt such that an appropriate one of the auxiliary rollers 50 contacts the ground simultaneously with the main rollers 31, thereby attributing a controlled and stabilized turning action to the roller skates. Furthermore, when the roller skates are braked, the roller skates tilt so that the auxiliary rollers 50 as shown in FIG. 6. When the screw fasteners 45 are loosened, the angle formed by the side plate portions 41 of the bracket 40 with the longitudinal axis of the skate body can be adjusted to suit the user's needs. It should be noted that the curved slot may be formed in the top plate portion 42 of the bracket 40 instead of the roller mounting frame 30 in order to achieve the same effect.

Figure 7:
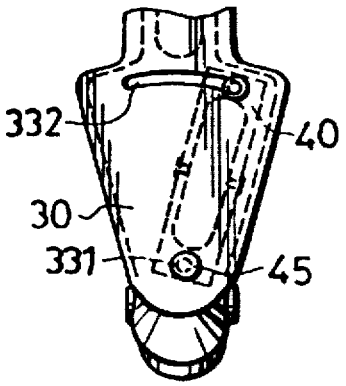
FIG. 7 is a fragmentary schematic top view of the third preferred embodiment of a roller skate according to the present invention.

FIG. 7 illustrates the third preferred embodiment of a roller skate according to the present invention. In the previous embodiment, the opening 331 is disposed in front of the curved slot 332. In the third preferred embodiment, however, the curved slot 332 is disposed in front of the opening 331.

Figure 8:
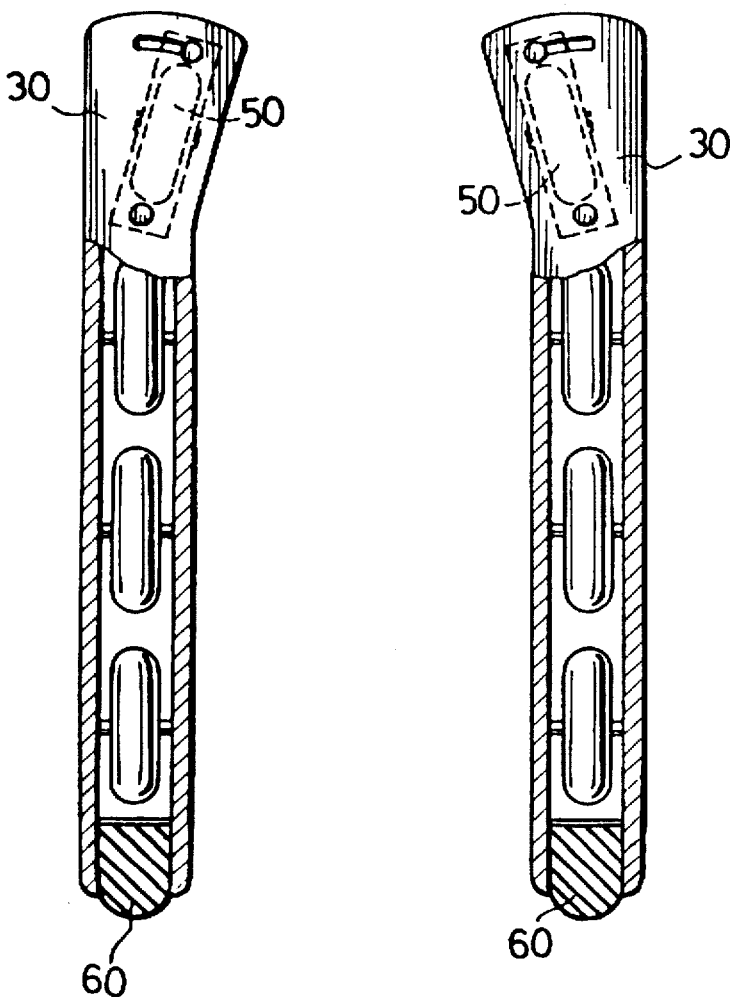
FIG. 8 is a partly sectional, schematic top view of a pair of roller skates of the fourth preferred embodiment.

FIG. 8 illustrates a pair of roller skates according to the fourth preferred embodiment of the present invention. Unlike the previous embodiments, the bracket 40 is disposed on the front end of the roller mounting frame 30. The brake device 60 is still installed on the rear end of the roller mounting frame 30.

Figure 9:
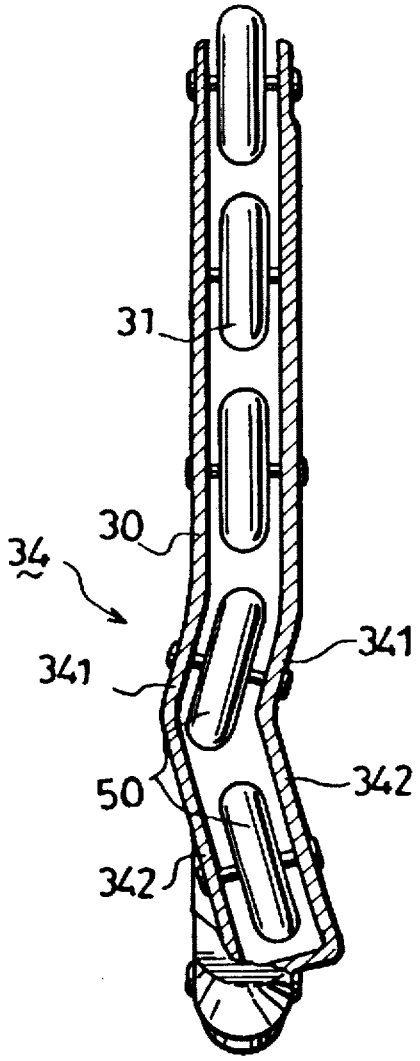
FIG. 9 is a partly sectional, schematic top view of a roller skate of the fifth preferred embodiment of this invention.

The fifth preferred embodiment of this invention, which is a modified version of the first preferred embodiment, is shown in FIG. 9. As illustrated, a bracket 34 also extends integrally from the rear end of the roller mounting frame 30. The bracket 34 has a spaced pair of parallel first side plate portions 341 contact the ground. Since the auxiliary rollers 50 do not lie on the longitudinal axis of the skate body (not shown), the auxiliary rollers 50 provide a movement-impeding action in addition to the action provided by the brake device (not shown).

FIG. 5 illustrates the connection among the roller mounting frame 30, the bracket 40 and the auxiliary roller 50. As shown, the bracket 40 has a pair of side plate portions 41 and a top plate portion 42 interconnecting top ends of the side plate portions 41. The side plate portions 41 are formed with aligned pin holes which permit extension of a pin 501 for mounting rotatably the auxiliary roller 50 to the bracket 40. The top plate portion 42 has front and rear sections formed respectively with a fastener hole 420. The roller mounting frame 30 is formed with openings 331, 332 which are aligned respectively with the fastener holes 420. Screw fasteners 45, which include a nut and a bolt, extend through the fastener holes 420 and the openings 331, 332 to mount the bracket 40 onto the roller mounting frame 30. Preferably, a rubber pad 43 is provided between each end of the fastener 45 and the corresponding one of the roller mounting frame 30 and the bracket 40 for shock-absorbing purposes.

The openings 331, 332 in the roller mounting frame 30 may be formed as screw holes. However, in this embodiment, the opening 332 is formed as a curved slot, which form an angle with the longitudinal axis of the skate body (not shown) and which have a first auxiliary roller 50 mounted rotatably thereon. The bracket 34 further has a spaced pair of parallel second side plate portions 342 which extend inclinedly and respectively from the first side plate portions 341 in a direction opposite to that of the first side plate portions 341. The second side plate portions 342 also form an angle with the longitudinal axis of the skate body (not shown) and have a second auxiliary roller 50 mounted rotatably thereon. As with the previous embodiments, the auxiliary rollers 50 have a raised bottom with respect to the main rollers 31.

In use, when the roller skate of this embodiment tilts while turning to the right, the first auxiliary roller 50 contacts the ground to assist in turning action of the roller skate. The second auxiliary roller 50 is not in contact with the ground at this time. Similarly, when the roller skate tilts while turning to the left, the second auxiliary roller 50 contacts the ground to assist in turning action of the roller skate. The first auxiliary roller 50 is not in contact with the ground at this time.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A roller skate comprising:

a skate body having front and rear ends and a bottom side with a plurality of main rollers mounted rotatably thereon along a longitudinal axis which extends between said front and rear ends;

a bracket connected to said bottom side of said skate body at one of said front and rear ends and having a spaced pair of parallel first side plate portions which form an angle with said longitudinal axis of said skate body;

a first auxiliary roller disposed between said first side plate portions of said bracket and mounted rotatably thereon; and a roller mounting frame having a spaced pair of parallel side walls, said main rollers being disposed between said side walls and being mounted rotatably thereon, said bracket extending integrally from said roller mounting frame.

2. The roller skate as claimed in claim 1, wherein said first auxiliary roller has a raised bottom with respect to said main rollers.

3. The roller skate as claimed in claim 1, wherein said first side plate portions form an angle between 0° and 60° with respect to said longitudinal axis of said skate body.

4. A roller skate comprising:

a skate body having front and rear ends and a bottom side with a plurality of main rollers mounted rotatably thereon along a longitudinal axis which extends between said front and rear ends;

a bracket connected to said bottom side of said skate body at one of said front and rear ends and having a spaced pair of parallel first side plate portions which form an angle with said longitudinal axis of said skate body, wherein said bracket further has a top plate portion which is mounted rotatably on said bottom side of said skate body and which interconnects top ends of the first side plate portions, one of said top plate portion of said bracket and said skate body being formed with a curved slot, the other one of said top plate portion of said bracket and said skate body being provided with a fastener which extends into said curved slot to retain adjustably said first side plate portions at a desired angle with respect to said longitudinal axis of said skate body; and a first auxiliary roller disposed between said first side plate portions of said bracket and mounted rotatably thereon.

5. The roller skate as claimed in claim 4, wherein said first auxiliary roller has a raised bottom with respect to said main rollers.

6. The roller skate as claimed in claim 4, wherein said first side plate portions form an angle between 0° and 60° with respect to said longitudinal axis of said skate body.

7. A roller skate comprising:

a skate,body having front and rear ends and a bottom side with a plurality of main rollers mounted rotatably thereon along a longitudinal axis which extends between said front and rear ends;

a bracket connected to said bottom side of said skate body at one of said front and rear ends and having a spaced pair of parallel first side plate portions which form an angle with said longitudinal axis of said skate body and a spaced pair of parallel second side plate portions which extend inclinedly and respectively from said first side plate portions in a direction opposite to that of said first side plate portions, said second side plate portions forming an angle with said longitudinal axis of said skate body;

a first auxiliary roller disposed between said first side plate portions of said bracket and mounted rotatably thereon; and a second auxiliary roller disposed between said second side plate portions of said bracket and mounted rotatably thereon.

8. The roller skate as claimed in claim 7, wherein said first auxiliary roller has a raised bottom with respect to said main rollers.

9. The roller skate as claimed in claim 7, wherein said first side plate portions form an angle between 0° and 60° with respect to said longitudinal axis of said skate body.

* * * * *